United States Patent [19]

Fries

[11] 3,946,237

[45] Mar. 23, 1976

[54] SUPPORT HOUSING FOR RADIOISOTOPE GENERATION

[75] Inventor: Bernard A. Fries, Orinda, Calif.

[73] Assignee: Chevron Research Company, San Francisco, Calif.

[22] Filed: Aug. 5, 1974

[21] Appl. No.: 495,006

[52] U.S. Cl. ..... 250/432 PD

[51] Int. Cl.[2] ..... G21G 4/08

[58] Field of Search ..... 250/308, 428, 430, 432, 250/434, 435, 493, 496, 497, 506, 507, 515, 432 PO; 252/301.1 R, 301.15; 23/252 R; 128/1.1, 1.2

[56] References Cited

UNITED STATES PATENTS

| | | | |
|---|---|---|---|
| 3,576,998 | 5/1971 | Deutsch et al. | 250/432 |
| 3,774,035 | 11/1973 | Litt | 250/430 |

*Primary Examiner*—Davis L. Willis

*Attorney, Agent, or Firm*—R. L. Freeland, Jr.; H. D. Messner

[57] ABSTRACT

A support housing for on-site radioisotope generation is disclosed in which the formation of a short-lived daughter radioisotope from its longer-lived parent features countercurrent batch flow of the eluting reagent interior of the housing.

6 Claims, 4 Drawing Figures

SUPPORT HOUSING FOR RADIOISOTOPE GENERATION

RELATED APPLICATION

Application Ser. No. 495,007, Bernard A. Fries, for "Shielded Radioisotope Generator and Method for Using Same," filed simultaneously herewith, is incorporated herein by reference.

BACKGROUND OF THE INVENTION

The invention relates to support means for radioisotope generation for use in various on-site industrial and medical applications, and has an object the provision of a novel housing in which the formation of a short-lived daughter radioisotope from its longer-lived parent features counter-current batch flow of the eluting fluid of the separation system.

DESCRIPTION OF THE PRIOR ART

To perform diagnostic tests in various industrial and medical radioapplications, short-lived nuclides are particularly attractive. However, the short-lived radioisotopes lose much of their radioactivity during their transportation from the manufacturer to the application sites. To use them effectively, it is necessary to be near a source of production of short-lived nuclides, or to use what is called a "nuclide generator." This device makes short-lived nuclides available at long distances from the source of production and consists of a longer-lived parent nuclide that produces a short-lived daughter as it decays. Usually the daughter nuclide is separated by chemical means as it is needed and the parent is left to generate a fresh daughter.

A generator is based on the principle that a daughter nuclide can be separated readily and repeatedly from its longer-lived parent nuclide. Differences in chemical behavior are used to achieve the separation. The general relationship between parent and daughter radioactivity can be derived from the interaction of the decay constants of the two radionuclides. After the daughter nuclide has been removed from the parent, the daughter activity increases progressively as the parent decays until they reach a state of transient equilibrium, at which point the ratio of the two activities remains constant and both appear to decay with the half-life of the parent.

A typical commercially available generator of technetium-99m ($^{99M}$Tc) consists of a small glass column containing aluminum oxide on which the parent isotope activity molybdenum-99 ($^{99}$Mo) is firmly absorbed. The alumina is retained in the tube by a porous glass disk. The daughter activity is eluted by gravity from the generator by pouring the proper reagents on the top of the column and collecting the eluate from the bottom.

In another typical nuclide generator, an artificial barrier (filter) is placed across a tubular column to form separate chambers. The open end of the column is sealed with a puncturable stopper after a suspension of non-replenishible ("one-shot") radioactive parent nuclide material has been disposed in the more remote chamber of the column. A transient equilibrium state between parent and daughter isotope occurs; thereafter the daughter nuclide solution can be withdrawn — under pressure — by inserting and then operating a syringe relative to the second chamber of the column.

SUMMARY OF THE INVENTION

In accordance with the present invention, a central glass column means suitable for supporting an exchange bed and parent isotope, e.g., $^{137}$Cs, is positioned entirely within and permanently mounted relative to a bulbous glass bottle means, such column means extending from a remote bottom wall of the glass bottle means. The resulting annular space formed between the side walls of the bottle and column means is open at one end but closed at the other to form a reservoir into which a suitable eluting reagent for radioisotope generation, as explained below, is placed. The flow direction of the reagent, prior to transient equilibrium, i.e., during initialization of the process, is not straight through; instead, it follows a countercurrent flow pattern, initially flowing downward through the annular space. Then the reagent passes through radial openings in the side wall of the column means and enters into the interior of the latter and thence passes upward through a glass frit (also open to fluid flow) attached to the side wall of the column means.

The exchange bed having a parent isotope absorbed thereon extends above the glass frit. As the reagent contacts the exchange bed (and parent isotope) there is a release of the daughter isotope. Note that the direction of reagent flow is dictated by the constructional features of the support housing of the present invention. Its level at equilibrium is slightly higher than the upper end of the exchange bed; the level of which is conveniently indicated by a scale provided on the column means adjacent to the aforementioned exchange bed. Removal of the daughter radioisotope (called milking) is straightforward. An incremental amount of additional eluting reagent is added exterior of the column means; and an equilibrium amount of daughter radioisotope in solution is removed via suction (or the like) at a female ball joint of the column. Since the mouth of the bottle is relatively large, insertion of the elution reagent, as well as attachment of exterior pipette means to the ball joint, as explained below, to withdraw the daughter nuclide are easily facilitated.

Other features, advantages and objects of the invention will become more apparent from the following detailed description of a preferred embodiment when considered in conjunction with the accompanying drawings.

DETAILED DESCRIPTION OF A PREFERRED EMBODIMENT

Figure 1:
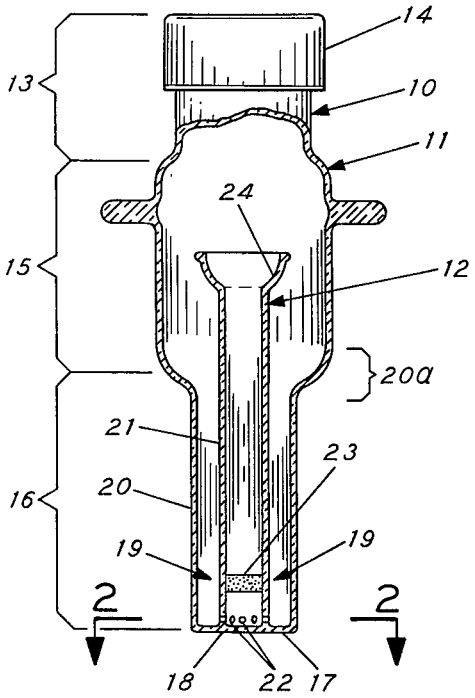
FIG. 1 is a side elevation, partially cut away, of the support housing of the present invention.
Figure 2:
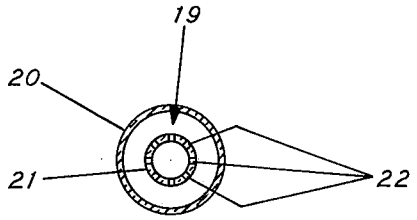
FIG. 2 is a section taken along line 2—2 of FIG. 1.

Reference should now be had to the drawings, particularly FIG. 1, in which glass support housing 10, useful in providing short-lived daughter radioisotopes from longer-lived parent isotopes for use in various industrial and medical applications, is shown.

Support housing 10 includes a bulbous bottle 11. Concentrically positioned interior of and coextensive therewith is central cylindrical column 12.

Bulbous bottle 11 includes threaded upper end 13. Attached to end 13 is cap 14; an enlarged mid-portion 15 is also provided, as is a reduced lower segment 16, the latter having a bottom wall 17 to which remote end 18 of column 12 is attached. Annular space 19 is defined between coextensive elements of the housing, say between adjacent surfaces of sidewall 20 of the bottle 11 and sidewall 21 of the central column 12. The space 19 is seen to be of constant nominal diameter over the lower segment 16 of the bottle, since the axis of symmetry of the bottle and column are co-linear in this region, but as the bottle is also seen to be enlarged over its midsection, the annular space 19 is likewise enlarged in step region 20*a*.

In order to allow fluid communication between the inner and outer surfaces of the column 12, a series of radial openings 22 are provided in sidewall 21 adjacent the end wall 17 of the bottle 11 (see FIG. 1). Above the openings 22, a glass frit support 23 is provided; frit 23 is open to fluid flow. Spaced still higher along the column, but below the cap 14 is female ball-joint member 24.

A support housing 10, in accordance with the present invention and having the following dimensions, has been constructed and successfully tested:

| | | |
|---|---|---|
| Bulbous bottle 11 | Material: glass | |
| | Dimensions | |
| Threaded upper end 13 | 3/16" OD × 1" high | |
| Mid-portion 15 | 1-1/6" OD × 1-1/4" high | |
| Lower segment 16 | 5/8" OD × 1-3/4" high | |
| Side wall 20 | 1/16" thick | |
| Column 12 | Material: glass | |
| | Dimensions | |
| Column 12 | 1/4" OD × 2-1/2" high | |
| Female ball-joint member 24 | $12/5 | 5/8" radius × 1/4" high |
| Side wall 21 | 1/32" thick | |

ON-SITE OPERATIONAL ASPECTS OF THE INVENTION

Operational aspects of the present invention in providing for on-site radioisotope generation are best illustrated with reference to FIGS. 3 and 4.

Figure 3:
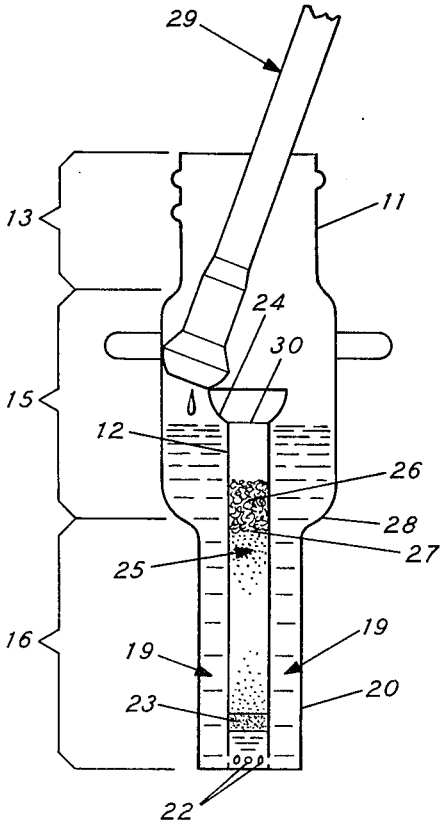
FIGS. 3 and 4 are schematic side elevations of the support housing of FIG. 1 illustrating steps bringing about its operation as a radioisotope generator.
Figure 4:
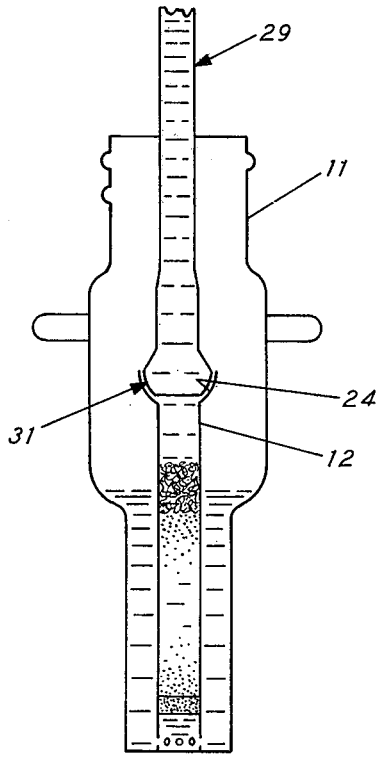

In FIG. 3, an ion-exchange bed 25, onto which a long-lived parent isotope is absorbed, is seen to be positioned between frit 23 and glass wool 26. Note that the upper end 27 of the bed 25 is adjacent to step 28 in the side wall 20 of the bottle 11; step 28 of the bottle separates mid-portion 15 and reduced lower segment 16, as previously described.

Ion-exchange bed 25 comprises, typically, treated stainless-steel powder over which a suitable surface layer has been laid. The parent isotope, e.g., $^{137}Cs$, is also present; in addition, the upper one-third of the bed can be provided with isotope-free particles to resist parent losses during daughter generation. A suitable surface layer combination includes iron hexacyanoferrate on stainless-steel particles onto which $^{137}Cs$, the long-lived parent isotope, has been absorbed. In this regard, see: *Radiochimica Acta.* 11, No. 3/4, pp. 153–158 (1969).

Next, the annular space 19 is filled with the suitable eluting reagent, e.g., dilute hydrogen chloride, until its level is slightly above the upper end of bed 25, as indicated by scale 30 on column 12. Of course, during initialization of the process, the reagent flows from the annular space 19 through openings 22 into contact with bed 25 in a countercurrent flow pattern.

Once the daughter nuclide has been removed from its parent, there is regrowth of the daughter to the transient equilibrium state. Thereafter, removal of the daughter radioisotope (called "milking") may be carried out repeatedly in a straightforward manner, as shown in FIGS. 3 and 4. As shown in FIG. 3, first an incremental volume-amount ("batch") of the reagent is added to the annular space 19 using a transfer pipette means 29; then the daughter nuclide, in the same volume-amount, is removed at the female ball-joint member 24 by placing it in contact with a male ball-joint member 31 of pipette means 29 as shown in FIG. 4. At the remote end of the pipette means 29, a suction means (not shown) is attached. The suction means may be attached to the pipette with long flexible tubing and the pipette means may be grasped with long-handled tongs to provide additional separation of the operator from the assembly, thereby reducing radiation hazards to a minimum. Thereafter, a selected amount of daughter radioisotope in solution is removed through activation of the suction means.

While a specific embodiment of the invention has been described, it should be understood that the invention is capable of other specific embodiments and modifications, and is to be solely defined by the following claims.

What is claimed is:

1. Housing for on-site radioactive parent-to-daughter isotope generation in which said parent radioisotope absorbed on an ion-exchange bed is selectively contacted with an eluting reagent to generate a short-lived daughter radioisotope, comprising:

i. bottle means having mouth and a central repository defined by a side wall and a bottom wall, ii. a cylindrical column means positioned within said repository of said bottle means by attachment to said bottom wall of said bottle means, and including means attached at its interior suitable for support of said ion-exchange bed, iii. said column means also including a series of openings through its side wall adjacent to said bottom wall of said bottle means whereby said eluting reagent during initialization of the process can be conveyed from a position exterior of said column means but interior of the bottle means through said openings and thence into said interior of said column means in a batch flow pattern, to subsequently provide for radioative parent-to-daughter isotope generation at said ion-exchange bed interior of said column means.

2. The housing of claim 1 in which said bottle and column means are formed of glass and have axes of symmetry of substantial co-linearity.

3. The housing of claim 2 in which said column means includes a second end opposite to its attaching end to said bottom wall of said bottle means capable of forming a pressure joint through surface contact with exterior transfer means of reciprocal shape thereto.

4. The housing of claim 3 in which said second end of said column means includes an outwardly diverging lip means forming a female ball-joint means suitable for attaching to a reciprocally shaped male ball-joint means of said exterior transfer means.

5. In combination, housing means for on-site radioactive parent-to-daughter isotope generation in which said parent radioisotope absorbed on an ion-exchange bed is selectively batch-contacted with an eluting reagent to generate said short-lived daughter isotope, omprising:

i. cylindrical column means having a side wall provided with openings and including means positioned interior of said column means suitable for supporting said ion-exchange bed, ii. bottle means having a mouth and a central repository defined by a side wall and a bottom wall in which said cylindrical column means is located, iii. said repository being larger than said cylindrical column means so as to form an annular space in fluid contact with the interior of said column means through said openings through its side wall, whereby said eluting reagent, when placed in said annular space can be easily conveyed through said openings for entry within said column means in a batch flow pattern, at least during initialization of the nuclide generation process.

6. The housing means of claim 5 further characterized in that said column and bottle means are of glass and define axes of symmetry of substantial co-linearity with one another.

* * * * *